United States Patent [19]

Heltemes

[11] Patent Number: 4,857,891

[45] Date of Patent: Aug. 15, 1989

[54] RANDOM-FILAMENT, MULTI-DIRECTIONALLY RESPONSIVE MARKER FOR USE IN ELECTRONIC ARTICLE SURVEILLANCE SYSTEMS

[75] Inventor: Eugene C. Heltemes, St. Paul, Minn.

[73] Assignee: Minnesota Mining and Manufacturing Company, St. Paul, Minn.

[21] Appl. No.: 188,456

[22] Filed: Apr. 29, 1988

[51] Int. Cl.[4] ..... G08B 13/24

[52] U.S. Cl. ..... 340/551; 340/572

[58] Field of Search ..... 340/551, 572

[56] References Cited

U.S. PATENT DOCUMENTS

| | | | |
|---|---|---|---|
| 3,665,449 | 5/1972 | Elder et al. | 340/280 |
| 3,747,086 | 7/1973 | Peterson | 340/280 |
| 3,790,945 | 2/1974 | Fearon | 340/280 |
| 4,075,618 | 2/1978 | Montean | 340/280 |
| 4,710,754 | 12/1987 | Montean | 340/572 |

FOREIGN PATENT DOCUMENTS 763681 11/1933 France .

*Primary Examiner*—Glen R. Swann, III
*Assistant Examiner*—Thomas J. Mullen, Jr.
*Attorney, Agent, or Firm*—Donald M. Sell; Walter N. Kirn; William B. Barte

[57] ABSTRACT

A magnetic marker for use with electronic article surveillance (EAS) systems in which a two-directional response is obtained. The marker comprises a substantially two-dimensional, sheet-like substrate having multiple metallic filaments randomly dispersed in or adhered thereto, so as to be substantially parallel to the plane thereof. The filaments are selected of low coercive force, high permeability material, and the random orientation results in certain filaments intersecting with the being magnetically coupled to other filaments to thereby collect and concentrate lines of flux associated with an applied field of an EAS system into filaments parallel to the field.

4 Claims, 1 Drawing Sheet

RANDOM-FILAMENT, MULTI-DIRECTIONALLY RESPONSIVE MARKER FOR USE IN ELECTRONIC ARTICLE SURVEILLANCE SYSTEMS

TECHNICAL FIELD

This invention relates to electronic article surveillance (EAS) systems and markers used therein, and in particular, to such markers in which the magnetization of magnetic material in the marker is changed by an alternating magnetic field in an interrogation zone to produce detectable signals indicating the presence of the marker.

BACKGROUND ART

It is now well known to utilize a piece of low coercive force, high permeability magnetic material as an EAS marker. Such markers were perhaps first disclosed in the French Pat. No. 763,681, issued in 1934 to Pierre Arthur Picard. More recently, it has become relatively well known to construct such markers of elongated strips of high permeability material in order to enhance the production of very high order harmonics, thereby improving the reliability with which such markers can be distinguished over signals from other articles such as briefcase frames, umbrellas, etc. Preferably, such elongated strips, often referred to as "open-strip" markers, exhibit a ratio of length to square root of cross-sectional area in excess of about 250. Such uses are exemplarily set forth in U.S. Pat. Nos. 3,665,449, 3,790,945 and 3,747,086. As such elongated strips are generally detectable only when the interrogating field is aligned with the strips, it is known from such disclosures to provide for multi-directional response by providing multi-directional fields in the interrogation zone or by providing additional strips in an L, T or X configuration. In the '449 patent it is also suggested that the marker comprise "closely spaced but, physically separate ferromagnetic strip held in fixed geometric relation to each other on or within a nonmagnetic substrate (such as very fine wire filaments or ribbons within a piece of paper)".

Markers such as disclosed in the above patents have all enjoyed certain commercial success. However, the use of the markers has been restricted by the size, and still primarily elongated shape heretofore believed to be necessary. Where additional sensitivity or shorter length markers are desired, it is disclosed in U.S. Pat. No. 4,075,618 (Montean) to provide flux concentrating elements on each end of the elongated strips.

Typical EAS systems originally designed to be used with elongated "open-strip" type markers, are the Model WH-1000 and 1200 systems, marketed by Minnesota Mining and Manufacturing Company. Such systems produce within the interrogation zones magnetic fields alternating at about 10 kHz, and having minimum intensities at the center of the zone of approximately 1.2 oersteds (Oe) when the fields generated in coils on opposite sides of the zone are in an opposing configuration and of approximately 2.4 Oe when in an aiding configuration. The two field configurations thus facilitate detection of a uni-directionally responsive marker oriented parallel to either of two directions.

DISCLOSURE OF INVENTION

The marker of the present invention obtains a high order harmonic, multi-directional response by employing multiple metallic filaments of a low coercive force, high permeability material, which filaments are randomly dispersed in or adhered to a substantially two-dimensional, sheet-like substrate. Many of the filaments are long and have a sufficiently small cross-section so as to satisfy the above-noted desirable lower limit of $L/\sqrt{A}>250$. Certain of the filaments randomly intersect near the ends of other filaments, and in which case, the intersecting filaments are desirably magnetically coupled together so as to collect and concentrate flux. In other, random situations, filaments may intersect nearer their centers. If such filaments are magnetically coupled together, each filament may magnetically "short-out" the other, making each appear to be shorter, thereby lessening the response. In any case, it has been surprisingly found that the net result of magnetic interaction between filaments is beneficial, so that a multi-directional, high level response is obtained.

In one embodiment, filaments comprising the present marker are preferably narrow ribbons having overall lengths in the range 0.2 to 1.0 inch and widths in the range between 0.001 and 0.020 inch. Such ribbons preferably are formed from thin sheets or foils ranging in thickness between 0.5 and 2 mil (0.01 to 0.05 mm). The above dimensions are provided only as a guide, and are not critical. Alternatively, short pieces of wire less than about 0.010 inch diameter may also be preferred. Longer and narrower filaments behave more like "open-strips", hence the flux gathering benefits of the intersecting filaments become less necessary. Similarly, while a larger number of filaments in a given area is desirable as the total mass is thus increased, ultimately the construction begins to function as a continuous sheet in which the overall demagnetization factor is greater, and poorer performance results.

The filaments are desirably formed of high permeability, low coercive force magnetic materials such as permalloy, supermalloy or the like and of analogous amorphous materials such as the Metglas® alloys 2826MB2 and 2705M, etc. manufactured by Allied-Signal Corporation, and the Vitrovac® alloy 6025, manufactured by Vacuumschemelze GmbH.

A marker such as described above is conveniently made dual-status, i.e., reversibly deactivatable and reactivatable by including at least one piece of remanently magnetizable material adjacent the layer containing the high permeable, low coercive force filaments. Such a piece, when magnetized, provides fields which bias the magnetization of the adjacent low coercive force filaments to alter the response of the marker resulting from the alternating magnetic field encountered in the interrogation zones.

DETAILED DESCRIPTION

Figure 1:
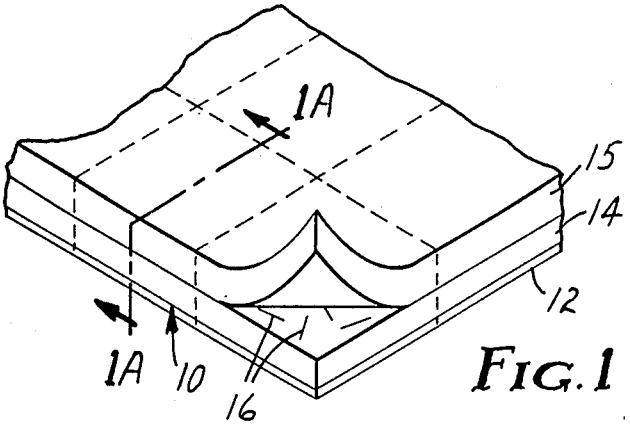
FIG. 1 is a perspective view of one embodiment of a marker of the present invention.

In a preferred embodiment of the present invention as shown in FIG. 1, a marker 10 may be constructed from a sheet of appropriate polymer 12 onto which is coated a dispersion 14 of a typical binder and a random mixture of filaments 16 of a low coercive force, high permeability magnetic material over which may be provided a printable paper cover 15. Thus, for example, the substrate 12 may be a 1 mil thick sheet of a typical polymer such as a polyester, polyvinyl, polyethylene or the like. The dispersion 14 may be any typical binder or paint composition and having randomly dispersed therein permalloy fibers which were originally ¾ of an inch long, 0.6 mils thick and approximately 6 mils wide. Preferably the permalloy filaments are added to the binder to provide a density of approximately 15 filaments per square inch. Typically such a marker construction will be formed of a large web of such a laminate and will be subsequently cut to provide a marker construction of approximately 1 ½ inches square. Accordingly, the length of the filaments randomly dispersed in the dispersion 14 will vary depending upon the position of a given filament with respect to the cut line.

Such a marker is shown in the cross sectional view 1A where it may be seen that the random dispersion of the filaments 16 within the dispersion 14 is such that some of the filaments may be slightly bent over where the filaments approach either the top or the bottom surface of the dispersion and that the filaments are randomly positioned within the coating.

When such markers were subsequently evaluated by placing it in the interrogation field of a Model 1000 electronic article surveillance system manufactured by Minnesota Mining and Manufacturing Company, it was found that the marker exhibited substantially the same sensitivity as a Quadratag® marker manufactured by Minnesota Mining and Manufacturing Company.

Figure 2:
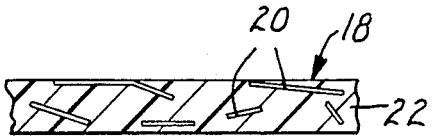
FIGS. 2 and 3 are cross sectional views of markers according to other embodiments of the present invention.
Figure 1A:
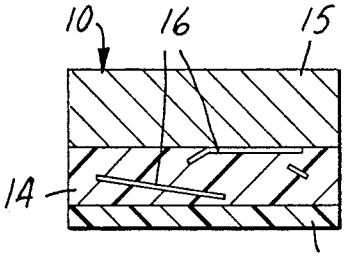
FIG. 1A is a cross sectional view of the embodiment of FIG., 1, taken along line 1A—1A.

As further shown in FIG. 2, an alternate construction of the present invention may comprise a marker 18, in which case no separate substrate is provided. Such a construction may conveniently be formed by randomly dispersing low coercive force filaments 20 in an appropriate flexible binder 22 and allowing the coating to solidify on an appropriate substrate, after which the resultant coating is striped away from the substrate to form a self supporting marker.

Figure 3:
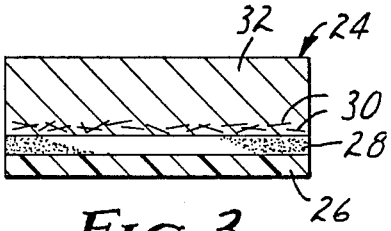

Alternatively, in another embodiment, a marker 24 may be formed as shown in FIG. 3 in which a substrate 26 such as a 1 mil sheet of polyester is provided with a layer of pressure-sensitive adhesive 28. Appropriately dimensioned filaments 30 may then be randomly positioned on the surface of the adhesive 28. A top layer 32 of paper may also be included to provide a printable surface for the ultimate marker. Such a layer 32 is desirably pressed onto the pressure-sensitive adhesive 28, thereby ensuring that the plane of the filaments 30 is primarily parallel to the plane of the marker. As in FIG. 1, constructions as shown in FIGS. 2 and 3 are desirably provided from large area webs which are subsequently converted by slitting or cutting the markers into the desired dimensions.

It has been found that the density of filaments such as described above in conjunction with FIGS. 1–3, may vary over a significant range. Thus, for example, in FIG. 1 a density of approximately 15 filaments having the dimensions indicated there per square inch was desirable. Where the density of filaments was reduced to approximately 10 filaments per square inch, the resultant sensitivity was found to decrease, as there was an insufficient volume of effectively oriented filaments present. Conversely, when the density of filaments was increased to approximately 20 filaments per square inch, the resultant sensitivity, while still being useable was observed to begin to decrease, thus indicating that the marker was beginning to take on the function of a continuous sheet such that the overall demagnetization factor was beginning to dominate.

It will be recognized that it is desirable to provide the filaments as long as possible. Such a result may, for example, be obtained by having the filaments longer than the dimensions of the ultimately configured marker such that the length of the filaments is ultimately determined by the size of the marker as cut from a larger sheet of randomly positioned filaments.

Figure 4:
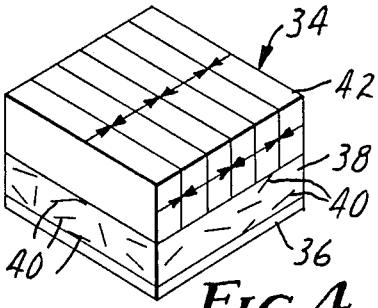
FIGS. 4 and 5 are perspective views of different embodiments of dual-status markers according to the present invention.

In the embodiments shown in FIGS. 1–3, a single status marker has been disclosed. In addition, and as shown in FIG. 4, a dual-status marker 34 may be provided by including another layer containing magnetizable material on top of the layer containing the low coercive force filaments. Thus as shown in FIG. 4, a marker 34 may comprise a substrate 36 such as a sheet of typical polymer, a dispersion 38 containing a binder and randomly dispersed filaments 40 of low coercive force, high permeability material, such as permalloy or the like, and a top sheet 42 of a permanently magnetizable material, such as vicalloy or the like. When such a marker 34 is imaged such as by magnetizing the layer 42 in alternating bands extending from one edge of the marker to the other, the resultant local fields associated with the magnetized bands will bias the filaments within the layer 38, thereby altering the response produced when the marker is subjected to the fields of an interrogation zone. Such a marker would thereby not produce a proper response and would said to be in a desensitized state. Alternatively, when the magnetization image is removed, such as by demagnetizing the layer 42 or uniformly magnetizing the layer to remove the alternating magnetic pattern, the marker would be able to respond and thus be said to be in a sensitized state. While filaments generally oriented perpendicular to the direction of the local fields may not be sufficiently affected, the affect of the fields on parallel oriented filaments is sufficient to result in an overall altered response.

Figure 5:
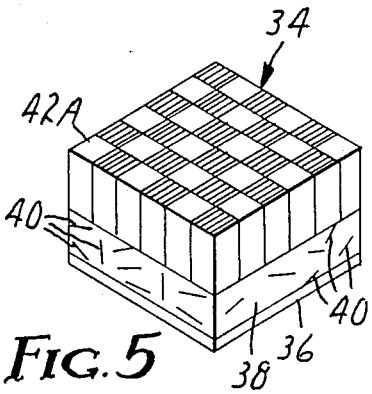

An alternative manner of desensitizing a dual-status marker is shown in FIG. 5. As there shown, the magnetized layer 42A of a marker 34 having the same construction as in FIG. 4, is magnetized in a checkerboard pattern of alternating polarities. Such a marker may also be sensitized as discussed above.

While in the embodiments discussed hereinabove, short filaments of crystalline low coercive force, high permeability material, such as permalloy, have been described, short filaments of amorphous ferromagnetic material may similarly be utilized. Such an embodiment may be preferable as the relative immunity of amorphous materials to mechanical handling may facilitate the production of the markers. This may be particularly the case where the filaments are dispersed within a binder prior to coating such that the filaments may be stressed during the process of coating and/or being pressed together between an underlying substrate and a top cover layer.

I claim:

1. A marker for use in an electronic article surveillance system of the type in which an alternating magnetic field in an interrogation zone produces remotely detectable magnetization changes in the marker, wherein the marker comprises a substantially two-dimensional, sheet-like substrate and multiple metallic filaments randomly dispersed in or adhered thereto so as to be substantially parallel to the plane thereof, said filaments being selected of a high permeability, low coercive force, magnetic material, with said filaments thereby randomly intersecting each other to magnetically couple therewith.

2. A marker according to claim 1, wherein all of said filaments are substantially the same dimension.

3. A marker according to claim 1, wherein all of said filaments are substantially the same composition.

4. A marker according to claim 1, further comprising at least one section of permanently magnetizable material positioned adjacent to a portion of said multiple filaments, and magnetically coupled thereto such that when so magnetized the detectable response resulting from the marker is altered.

* * * * *